US008770468B2

(12) United States Patent
Skolik et al.

(10) Patent No.: US 8,770,468 B2
(45) Date of Patent: Jul. 8, 2014

(54) FOLDING BOX FOR RECEIVING A GROUP OF CONTAINERS

(75) Inventors: Bernard Skolik, Bassum (DE); Jens Eckermann, Bremen (DE)

(73) Assignee: Graphic Packaging International Europe Netherlands B.V. (NL)

( * ) Notice: Subject to any disclaimer, the term of this patent is extended or adjusted under 35 U.S.C. 154(b) by 337 days.

(21) Appl. No.: 13/143,665

(22) PCT Filed: Jan. 6, 2010

(86) PCT No.: PCT/EP2010/000022

§ 371 (c)(1),
(2), (4) Date: Aug. 8, 2011

(87) PCT Pub. No.: WO2010/079124

PCT Pub. Date: Jul. 15, 2010

(65) Prior Publication Data

US 2011/0297739 A1 Dec. 8, 2011

(30) Foreign Application Priority Data

Jan. 9, 2009 (DE) ..... 20 2009 000 529 U

(51) Int. Cl.
*B65D 3/22* (2006.01)

(52) U.S. Cl.
USPC ..... 229/122.32; 229/122.33; 229/122.34; 229/199; 229/117.16; 229/931

(58) Field of Classification Search
USPC ..... 229/122.32–122.34, 199, 117.16, 931, 229/939
See application file for complete search history.

(56) References Cited

U.S. PATENT DOCUMENTS

| | | | | |
|---|---|---|---|---|
| 2,310,408 | A * | 2/1943 | Ehrenfeld | 229/117.16 |
| 2,330,294 | A * | 9/1943 | Leavitt et al. | 229/126 |
| 2,710,135 | A * | 6/1955 | Gaylord | 229/117.16 |
| 2,808,190 | A | 10/1957 | Buhrmaster et al. | |
| 3,007,622 | A * | 11/1961 | George | 229/122.21 |
| 3,027,060 | A * | 3/1962 | Beder | 229/164.1 |
| 3,275,217 | A * | 9/1966 | Dornbush et al. | 229/199 |
| 3,643,856 | A | 2/1972 | Jones | |
| 4,177,935 | A * | 12/1979 | Centanni | 229/122.34 |
| 4,905,864 | A * | 3/1990 | Balin | 229/122.32 |
| 5,219,089 | A * | 6/1993 | Kiolbasa et al. | 229/185.1 |
| 5,439,133 | A | 8/1995 | Stone | |
| 5,615,795 | A | 4/1997 | Tipps | |
| 6,170,741 | B1 * | 1/2001 | Skolik et al. | 229/117.13 |
| 6,328,202 | B1 * | 12/2001 | Giblin | 229/122.32 |
| 8,092,360 | B2 * | 1/2012 | Greenfield | 493/162 |
| 8,196,805 | B2 * | 6/2012 | Brand et al. | 229/117.32 |
| 2007/0267466 | A1 | 11/2007 | Brand et al. | |

FOREIGN PATENT DOCUMENTS

| | | |
|---|---|---|
| EP | 0 231 082 A2 | 8/1987 |
| WO | 97/27114 | 7/1997 |
| WO | 99/25621 | 5/1999 |
| WO | 2005/100175 A1 | 10/2005 |
| WO | 2007/080099 A1 | 7/2007 |

* cited by examiner

*Primary Examiner* — Gary Elkins
*Assistant Examiner* — Scott McNurlen
(74) *Attorney, Agent, or Firm* — Womble Carlyle Sandridge & Rice, LLP

(57) ABSTRACT

A folding box for receiving a group of containers includes a cuboid-shaped external packaging made of cardboard. The external packaging has side walls, bottom walls and top walls. The folding box also includes a lining on the inside of the external packaging at least in the corner region between the side walls, top walls and/or bottom walls.

22 Claims, 4 Drawing Sheets

FOLDING BOX FOR RECEIVING A GROUP OF CONTAINERS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a folding box for receiving a group of containers, in particular bottles.

Folding boxes made of corrugated cardboard are used for transporting containers, in particular for exporting beer bottles or other drinks bottles. The use of a standard transportation box, comprising side walls, bottom wall flaps and top wall flaps articulated to one another and made of (B-flute) corrugated cardboard with a thickness of approximately 3 mm, is widespread. The bottles are frequently inserted into compartments in the folding boxes in order to avoid contact between the glass. Such a folding box is known, for example, for exporting and receiving 24 beer bottles, each with a capacity of approximately 210 ml (7 fl. oz.). The print on folding boxes made of corrugated cardboard, however, is only able to be of average quality. Moreover, the blanks take up a large amount of space. In addition, the folding boxes may be easily deformed during transport. Also, the folding boxes made of corrugated cardboard are able to be relatively easily punctured and/or perforated.

For transporting bottles, folding boxes made of kraft cardboard have also already become known. Said boxes have improved printing properties. So that the kraft cardboard withstands the load of, for example, 24 bottles, kraft cardboard with a relatively high grammage is used.

Proceeding therefrom, the object of the invention is to provide a folding box for the transportation of containers, which has good printing properties and is less costly.

BRIEF SUMMARY OF THE INVENTION

The folding box according to the invention for receiving a group of containers comprises a cuboid-shaped external packaging made of cardboard and having side walls, bottom walls and top walls and a lining on the inside of the external packaging at least in the corner region between the side walls and top walls and/or bottom walls.

The folding box according to the invention has an external packaging made of cardboard so that it has better printing properties than conventional folding boxes made of corrugated card. Moreover, the folding box in at least one corner region is reinforced between the side walls and top walls and/or between the side walls and bottom walls by a lining. The lining in the erected folding box preferably has an L-shaped cross section in the respective corner region. The strength of the folding box in the respective corner region is increased by the lining. This specific arrangement of the lining is based on the surprising recognition that the folding boxes, in particular in the corner regions, are subjected to high loads, which may lead to damage. In particular, during the transportation of conventional folding boxes on pallets, the corner regions of boxes located on the outside may be dented.

If the folding boxes contain bottles, the upper corners are particularly at risk, as adjacent to the bottle necks particularly large free spaces are present, into which the material may deform. Also, the lower corner regions are at risk, as free spaces are also present between the circular bottom regions of adjacent bottles, which permit a deformation of the corners. These deformations in the folding box according to the invention are avoided by the external packaging made of cardboard and the lining in one or more corner regions. Additionally, the folding box according to the invention is protected against puncturing, in particular in the region of the lining. A folding box according to the invention is able to be produced with a total wall thickness of approximately 1 to 1.5 mm in the region of the lining, so that blanks of the folding box stacked on top of one another have a smaller space requirement and/or a stack of a specific height contains more blanks than in conventional folding boxes. The folding box according to the invention, therefore, has an improved capacity to be printed, an improved strength and logistical advantages.

The walls of the external packaging may be joined together in different ways. According to a preferred embodiment, the external packaging has side walls articulated to one another on transverse sides. In this embodiment, the side walls may be closed in different ways to form a frame. For example, a side wall is formed from two side wall portions overlapping one another and adhesively bonded to one another in the overlapping region, and which close the side walls which are articulated to one another to form a frame. According to a preferred embodiment, one side wall has an edge connecting tab which is articulated to a transverse side and which is joined to an adjacent side wall. Preferably, the edge connecting tab is adhesively bonded to the adjacent side wall, preferably to the inside of the adjacent side wall.

It is possible for the top wall and/or the bottom wall to be originally separate from the side walls and connected via further edge connecting tabs to the side walls. According to a preferred embodiment, the top wall is articulated to an upper longitudinal side and/or the bottom wall is articulated to a lower longitudinal side of at least one side wall. In combination with side walls which are articulated to one another, this permits the production of the external packaging from a one-piece blank made of cardboard.

According to a further embodiment, the top wall comprises a plurality of top wall flaps which are articulated to upper longitudinal sides of different side walls and/or the bottom wall comprises a plurality of bottom wall flaps which are articulated to the lower longitudinal sides of different side walls. The plurality of top wall flaps and/or the plurality of bottom wall flaps may partially overlap one another in the folded-up state so that the top wall and/or the bottom wall may be at least partially multi-layered. As a result, the top wall and/or the bottom wall may consist of a cardboard with a relatively low gsm (grammage), without material failure having to be feared. Moreover, a lining of the top wall and/or the bottom wall extending over the corner region may be dispensed with.

According to an embodiment, the side walls are articulated to one another via score lines, and/or the top wall and/or the bottom wall are articulated to at least one side wall via at least one score line. In principle, the articulations may also be implemented via discontinuous stamped lines. The score lines, however, simplify the folding of the cardboard relative to discontinuous stamped lines.

In principle, the folding box may be carried by gripping the lower corner regions. According to a preferred embodiment, at least one side wall has a handle opening. As a result, it is easier to carry the folding box. According to a preferred embodiment, the folding box has handle openings in opposing side walls in order to carry the folding box with both hands. According to a further embodiment, a handle flap is articulated to the upper edge of the handle opening. The handle flap distributes the load to a larger surface area of the cardboard when carried, whereby the upper edge of the handle opening is prevented from cutting into the hands.

In order to prevent the handle opening from tearing, according to a further embodiment an adhesive strip is arranged on the upper edge of the handle opening, on the inside of the side wall.

According to a preferred embodiment, the external packaging consists of kraft cardboard.

In principle, the lining may be present exclusively in at least one corner region of the folding box. In this case, for example, it may be an upper corner region, which is arranged externally for transporting the folding box on a pallet. Preferably, the lining is present in all corner regions between the top wall and the side walls and/or the bottom wall and the side walls.

According to a further embodiment, the lining comprises at least one inner side wall which has a reinforcement flap articulated to the upper and/or to the lower longitudinal side. This lining overlaps the inside of the side wall of the external packaging to which it is associated. Moreover, with the upper and/or the lower reinforcement flap it covers the adjacent upper and/or lower corner region of the folding box. In this case, the upper and/or the lower reinforcement flap bears on the inside against the edge region of the top wall and/or the bottom wall and also covers said top wall and/or bottom wall on the edge. The lining configured in this manner reinforces the external packaging on the side walls between the corner regions, so that damage and/or puncturing are more easily prevented there. Moreover, the lining comprising an inner side wall may be easily attached to the inside of the external packaging, for example by adhesive bonding. In contrast, linings in the form of strips and/or corners exclusively reinforcing the corner regions have to be attached separately to the upper and lower longitudinal sides.

In principle, the lining may be arranged on only one side wall which is particularly at risk, for example as it is arranged on the outside on a pallet during transport of the folding box. According to a preferred embodiment, the lining is arranged on a plurality of side walls. Preferably, said lining is arranged on all side walls of the folding box in order to reinforce the folding box all around. According to a preferred embodiment, the lining has a plurality of inner side walls articulated to one another on transverse sides. As a result, the attachment of a lining which covers a plurality of side walls of the external packaging on the inside is simplified. According to a further embodiment, the inner side walls are articulated to one another via webs. By means of the webs, material accumulations of the lining in the corner regions between the side walls, which may prevent folding of the folding box and/or may lead to deformation of the corner regions, are avoided. According to a further embodiment, the webs are arranged in the lower half of the transverse sides. The material accumulations caused by the webs, therefore, are arranged in the lower region of the folding box and are less noticeable.

According to a further embodiment, the score lines are slit open between the side walls of the external packaging at the points at which the webs of the lining are present. When folding the folding box, therefore, the webs are able to spread into the slits. By arranging the webs in the lower half of the transverse sides, the slits are less present in the lower half of the corners between the longitudinal sides.

According to a further embodiment, at least one inner side wall has an inner handle opening which overlaps a handle opening of the external packaging. By means of the handle opening, in combination with the inner handle opening, the surface area for gripping the folding box is increased so that the upper edges of the handle openings cut to a lesser degree into the hand of the user. According to a further embodiment, an inner handle flap is articulated to the upper edge of the inner handle opening which further cushions the handle opening.

According to a further embodiment, the inner side walls are articulated to one another via score lines, and/or the reinforcement flap is articulated to the inner side wall via a score line and/or a discontinuous stamped line, and/or the inner handle flap is articulated to an inner side wall via a score line and/or a discontinuous stamped line. The score lines may extend over the webs which join adjacent side walls together. An articulation via a score line in combination with a discontinuous stamped line simplifies the folding, in particular, when the lining consists of a brittle and/or fragile material.

Different materials are considered for the lining. In particular, the lining may be formed from plastics film and/or a self-adhesive plastics strip, which only reinforces the corner regions. Preferably, the lining consists of a foldable planar material, in particular made of cardboard. Further preferably, the lining consists of recycled cardboard. For the lining, recycled cardboard and thus a low-quality material may be used, in particular as the lining does not need to be printed on. With the use of recycled cardboard, sufficient reinforcement is provided in the corner region and optionally the side wall of the external packaging.

In principle, it is possible to arrange the lining loosely in the external packaging, the lining being able to be fixed between a compartment and/or inserted bottles and the external packaging. According to a preferred embodiment, the lining is adhesively bonded to the external packaging. As a result, in particular, the erection and filling of the folding box is simplified.

Further preferably, the lining is adhesively bonded to the external packaging at the outer edges of the inner side walls. Further preferably, the adhesive bonding is present along the longitudinal sides and/or the transverse sides of the inner side walls.

According to a preferred embodiment, the lining is adhesively bonded to the external packaging approximately in the middle of the central side walls. As a result, the side walls of the external packaging are prevented from bulging out. Adhesive is saved relative to flat bonding of the lining to the packaging.

According to a further embodiment, the lining is not adhesively bonded to the external packaging at the reinforcement flaps. As a result, the displacement on the reinforcement flaps relative to the external packaging which occurs when the folding box is erected is not hindered.

According to a further embodiment, the folding box contains a compartment. In this case, for example, it may be compartments which form the subject-matter of WO 2007/080099 A1, which are included in the present application by reference.

According to a further embodiment, the folding box contains a group of bottles.

Moreover, the invention relates to a combination of blanks for producing a folding box according to the invention comprising a blank made of cardboard for producing an external packaging comprising four side walls articulated to one another on transverse sides, an edge connecting tab articulated to one transverse side, top wall flaps of a top wall articulated to upper longitudinal sides of the side walls and bottom wall flaps of a bottom wall articulated to lower longitudinal sides of the side walls and a blank of a lining made of a foldable planar material with side walls articulated to one another on transverse sides and reinforcement flaps articulated to upper and/or lower longitudinal sides of the side walls.

According to one embodiment, the blank of the external packaging is in one piece and/or the blank of the lining is in one piece.

According to a further embodiment, the blanks of the external packaging and the lining are adhesively bonded to one another.

According to a further embodiment, the blank of the external packaging consists of kraft cardboard and/or the blank of the lining consists of recycled cardboard.

According to further embodiments, the blanks of the external packaging and/or the lining comprise individual or several features of the external packaging and/or the lining which are set forth in the claims for the folding box.

The invention is described in more detail hereinafter with reference to the accompanying drawings of exemplary embodiments, in which:

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the present application, the terms "top" and "bottom" and/or "upper" and "lower" relate to the arrangement of the folding box in the erected state with the top wall at the top and the bottom wall at the bottom.

Figure 1:
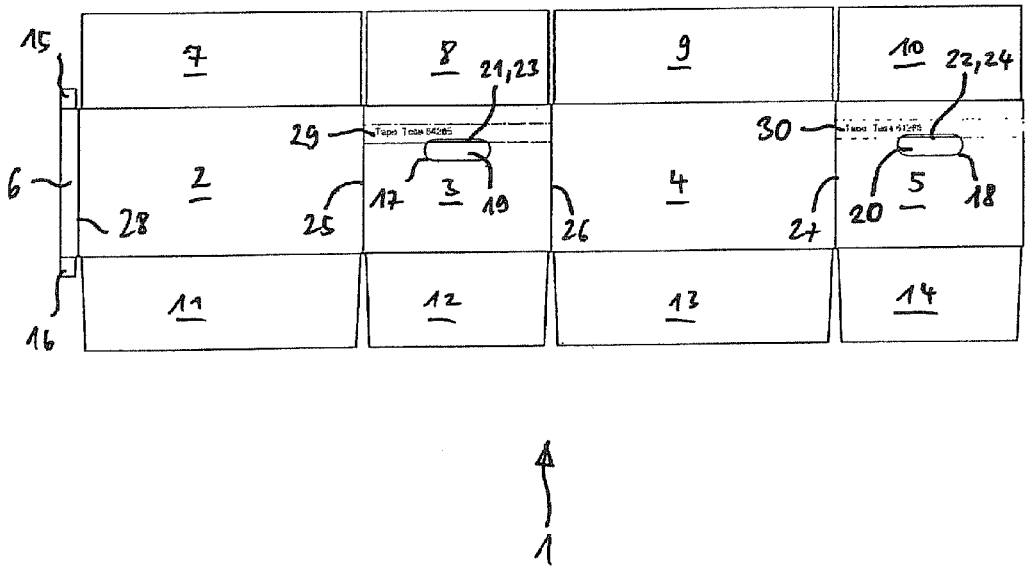
FIG. 1 shows a blank of an external packaging of the folding box, lying flat in plan view.

According to FIG. 1, a blank 1 of an external packaging (also denoted by "1") in each case comprises approximately rectangular side walls 2, 3, 4, 5 which are articulated to one another on transverse sides. The side wall 2 has an edge connecting tab 6 articulated to one transverse side.

Top wall flaps 7, 8, 9, 10 are articulated to the upper longitudinal sides of the side walls 2 to 5. Bottom wall flaps 11, 12, 13, 14 are articulated to the lower longitudinal sides of the side walls 2 to 5. Moreover, a dust flap 15 is articulated to the upper longitudinal side of the edge connecting tab 6 and a dust flap 16 is articulated to the lower longitudinal side of the edge connecting tab 6.

The top wall flaps 7 to 10 are rectangular. The bottom wall flaps 11 to 14 are slightly trapezoidal.

In the shorter side walls 3, 5 in each case an oval handle opening 17, 18 is present. Each handle opening has a handle flap 19, 20 articulated to its upper edge. Each handle flap 19, 20 is articulated via a pair of score lines 21, 22 and a pair of discontinuous stamped lines 23, 24 arranged thereon.

The side walls 2, 3, 4, 5 and the edge connecting tab 6 are articulated to one another via score lines 25, 26, 27, 28. The score lines 25, 26, 27, 28 are interrupted in the lower halves of the side walls 2, 3, 4, 5, by means of stamped lines, which are not shown.

Adhesive strips 29, 30 extend over the side walls 3, 5, above the handle openings 17, 18.

The blank 1 is produced in one piece from kraft cardboard. The adhesive strips 29, 30 consist of plastics and are provided on one side with a line of adhesive.

Figure 2:
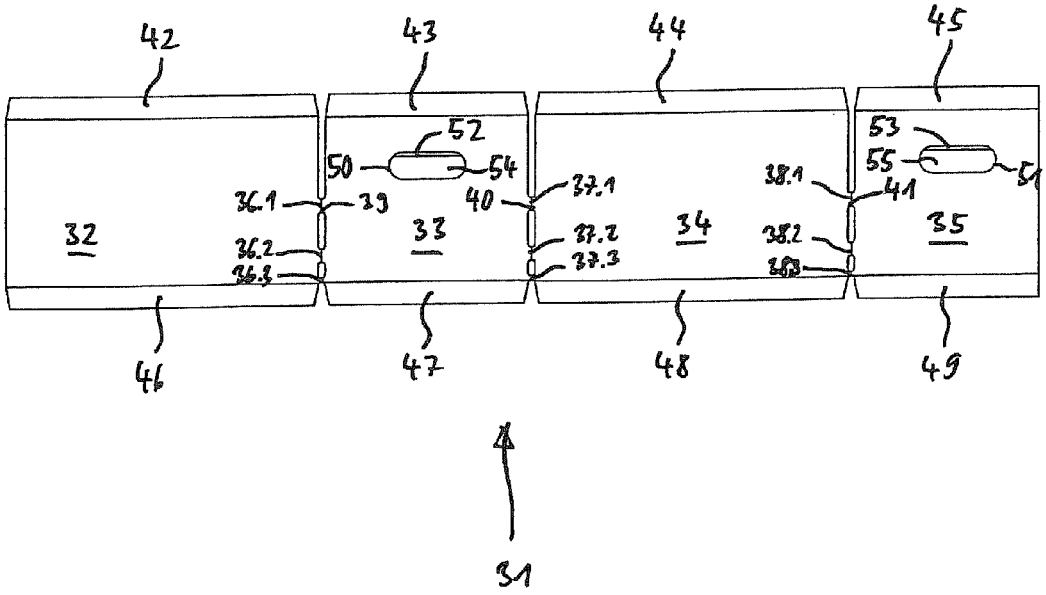
FIG. 2 shows a blank of the lining of the folding box, lying flat in plan view.

According to FIG. 2, a blank 31 of a lining (also denoted by "31") has side walls 32, 33, 34, 35 articulated to one another on transverse sides. The side walls 32 to 35 are in each case articulated to one another via a plurality of webs 36.1 to 36.3, 37.1 to 37.3 and 38.1 to 38.3. Free spaces are present therebetween. Score lines 39, 40, 41 extend transversely over the webs 36 to 38.

Moreover, upper reinforcement flaps 42, 43, 44, 45 are articulated to the upper longitudinal sides of the inner side walls 32 to 35 via score lines. Lower reinforcement flaps 46, 47, 48, 49 are articulated to the longitudinal sides of the inner side walls 32 to 35 via score lines.

The shorter side walls 35, 35 in each case have an oval inner handle opening 50, 51. In each case an inner handle flap 54, 55 is articulated to the upper edge of each handle opening 50, 51 via a pair of discontinuous stamped lines 52, 53.

The blank 31 consists of recycled cardboard.

Figure 3:
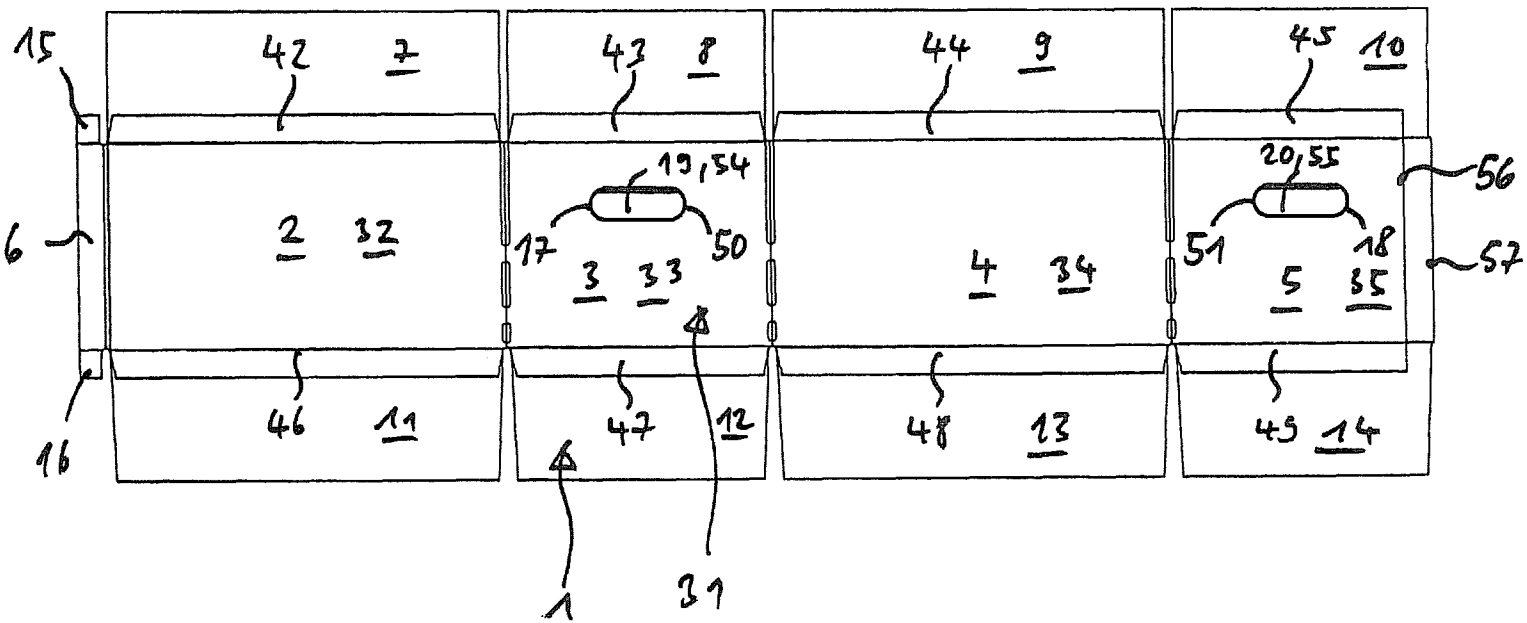
FIG. 3 shows the blanks of the external packaging and the lining connected together, lying flat in plan view.

According to FIG. 3, the blank 31 is placed onto the inside of the blank 1 and adhesively bonded thereto. The adhesive portions are applied in strips along the longitudinal sides and the transverse sides of the side walls 2 to 5 and the inner side walls 32 to 35. Moreover, the side walls 2 to 5 and the associated inner side walls 32 to 35 are connected in each case via a central adhesive portion in the form of an adhesive point or a plurality of adhesive points or an adhesive surface. The handle openings 17, 18 and the inner handle openings 50, 51 overlap one another in a congruent manner. The upper reinforcement flaps 42 to 45 are not adhesively bonded to the top wall flaps 7, 10 and the lower reinforcement flaps 46 to 49 are not adhesively bonded to the bottom wall flaps 11 to 14. The webs 36 to 38 are located exactly over the slits in the score lines, which connect the side walls 2 to 5 together. Moreover, FIG. 3 shows that the free transverse side 56 of the inner side wall 35 terminates with a clear spacing from the free transverse side 57 of the side wall 5, this spacing corresponding to the width of the edge connecting tab 6.

This combination of blanks 1, 31 is closed to form a sleeve by adhesively bonding the edge connecting tab 6 to the inside of the side wall 5 in the above-described spacing region. Preferably, this is carried out by the manufacturer of the folding box. The combination of the blanks 1, 31 which have been previously bonded together is erected in a brewery, by pressing against the opposing corners. Then the bottom wall flaps 11 to 14 are folded into the lower openings and adhesively bonded together. Moreover, a compartment may be inserted into the folding box. Finally, bottles are inserted and the folding box closed by flapping down and adhesively bonding together the top wall portions 7 to 10.

The bottom wall portions 11 to 14 together form a bottom wall 58 and the top wall portions 7 to 10 together form a top wall 59.

Figure 4:
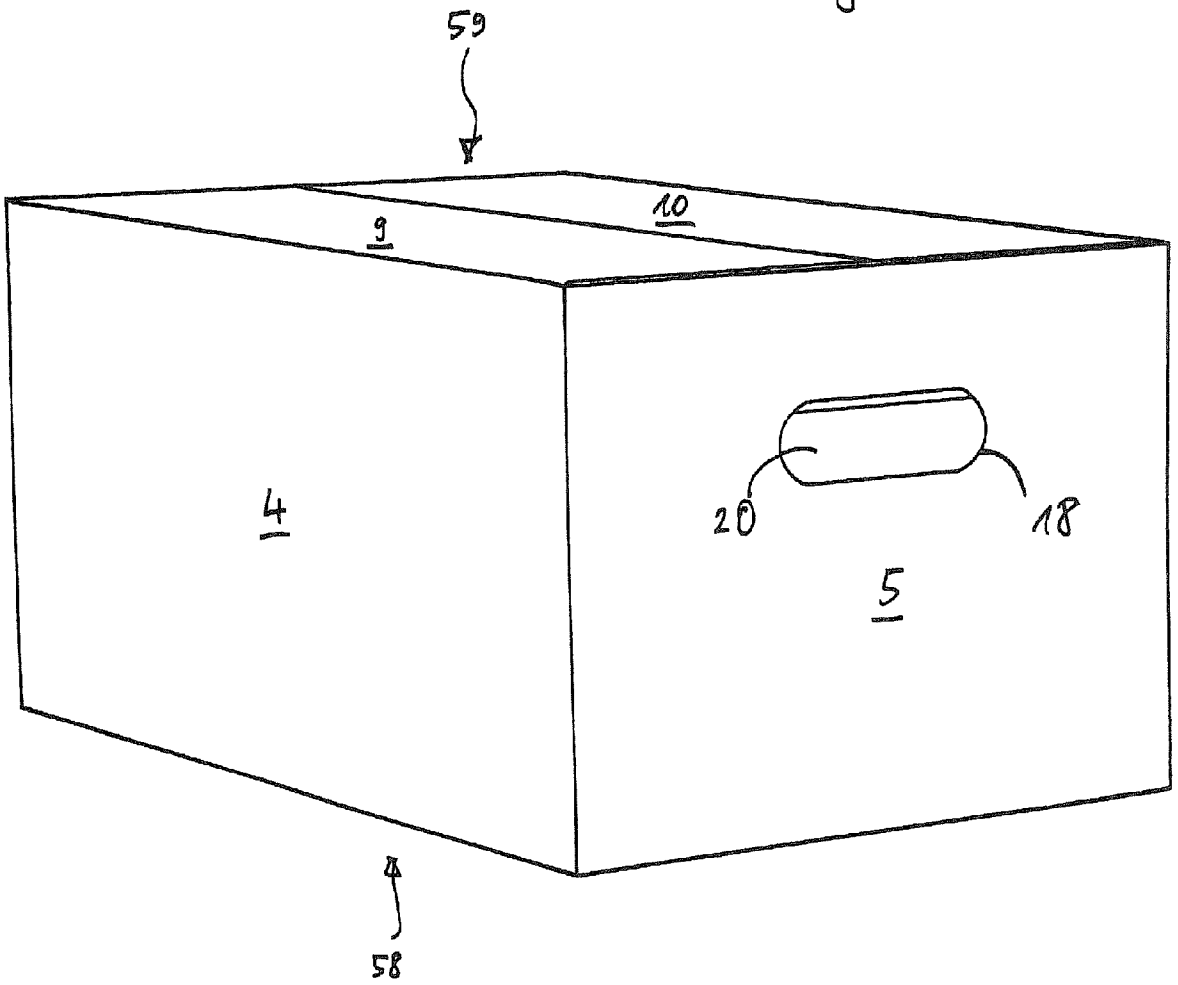
FIG. 4 shows a folding box consisting of the blanks according to FIGS. 1 to 3 in the erected state.

According to FIG. 4, the package thus formed, in particular, is protected against damage on the upper and lower corner regions and on the side walls 2 to 5. The side walls 2 to 5 may be provided with a high quality print, as said side walls consist of kraft cardboard. The same applies to the bottom wall 58 and the top wall 59.

For carrying the folding boxes, the handle flaps 19, 54, 20, 55 may be pressed inwards using the hands. The upper edge of the handle openings 17, 50, 18, 51 is very well cushioned by a plurality of layers of foldable planar material of the blanks 1 and 31 against the hands which grip around the upper edge. Additionally, the upper edge is also protected against tearing by the adhesive strips and/or tapes 29, 30.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A folding box for receiving a group of containers comprising:

a cuboid-shaped external packaging made of cardboard and having side walls, bottom walls and top walls; and lining on the inside of the external packaging at least in the corner region between the side walls and top walls or bottom walls, wherein the lining comprises at least two inner side walls which are adhesively bonded to the external packaging and which has a reinforcement flap articulated to the upper or to the lower longitudinal side, wherein the lining is not adhesively bonded to the external packaging at the reinforcement flaps, wherein the at least two inner side walls are articulated to one another via webs, wherein the webs are arranged in the lower half of the transverse sides, the side walls are articulated to one another via score lines or the top wall or the bottom wall are articulated to at least one side wall via at least one score line, and wherein the score lines are slit open between the side walls of the external packaging at the points at which the webs of the lining are present.

2. The folding box according to claim 1, in which the external packaging has side walls articulated to one another on transverse sides.

3. The folding box according to claim 2, in which one side wall has an edge connecting tab articulated to a transverse side and which is joined to an adjacent side wall.

4. The folding box according to one of claim 1, in which the top wall is articulated to an upper longitudinal side or the bottom wall is articulated to a lower longitudinal side of at least one side wall.

5. The folding box according to claim 4, in which the top wall comprises a plurality of top wall flaps which are articulated to upper longitudinal sides of different side walls, or in which the bottom wall comprises a plurality of bottom wall flaps which are articulated to the lower longitudinal sides of different side walls.

6. The folding box according to claim 1, in which at least one side wall has a handle opening.

7. The folding box according to claim 6, which has handle openings in two opposing side walls.

8. The folding box according to claim 6, in which a handle flap is articulated to the upper edge of the handle opening.

9. The folding box according to claim 6, in which an adhesive strip is arranged on the upper edge of the handle opening, on the inside of the side wall.

10. The folding box according to claim 1, in which the external packaging consists of kraft cardboard.

11. The folding box according to claim 1, in which the lining has a plurality of inner side walls articulated to one another on transverse sides.

12. The folding box according to claim 1, in which at least one inner side wall has an inner handle opening which overlaps a handle opening of the external packaging.

13. The folding box according to claim 12, in which an inner handle flap is articulated to the upper edge of the inner handle opening.

14. The folding box according to claim 1, in which the inner side walls are articulated to one another via score lines, or in which the reinforcement flap is articulated to the inner side wall via a score line or a discontinuous stamped line, or the inner handle flap is articulated to an inner side wall via a score line or a discontinuous stamped line.

15. The folding box according to claim 1, in which the lining consists of recycled cardboard.

16. The folding box according to claim 1, in which the lining is adhesively bonded to the external packaging at the outer edges of the inner side walls.

17. The folding box according to claim 1, in which the lining is adhesively bonded to the external packaging approximately in the middle of the inner side walls.

18. The folding box according to claim 1, containing a compartment.

19. The folding box according to claim 1, containing a group of bottles.

20. The folding box according to claim 1, wherein the webs comprise portions of the lining, each of the portions of the lining being located between openings in the lining.

21. The folding box according to claim 20, wherein the portions of the lining comprise a score line extending between the openings.

22. A folding box for receiving a group of containers comprising:

an external packaging made of cardboard and having side walls, bottom walls and top walls; and a lining on the inside of the external packaging at least in the corner region between the side walls and top walls or bottom walls;

wherein the lining comprises inner side walls which are adhesively bonded to the external packaging and which have at least one reinforcement flap articulated to the upper or to the lower longitudinal side, wherein the side walls are articulated to one another via score lines, wherein the inner side walls are articulated to one another via webs, and wherein the score lines are slit open between the side walls of the external packaging at the points at which the webs of the lining are present.

* * * * *